US005232036A

United States Patent [19]

Brutsaert

[11] Patent Number: 5,232,036

[45] Date of Patent: Aug. 3, 1993

[54] ROLL-UP AWNING

[76] Inventor: L. Brutsaert, Kortrijksestraat 343, B-8930 Menen, Belgium

[21] Appl. No.: 676,069

[22] Filed: Mar. 27, 1991

[30] Foreign Application Priority Data

Sep. 28, 1990 [WO] World Int. Prop. O. .... DM/017725
Feb. 27, 1991 [BE] Belgium ..... 9100186

[51] Int. Cl.[5] ..... E04F 10/06

[52] U.S. Cl. ..... 160/70; 160/66; 160/79

[58] Field of Search ..... 160/70, 68, 71, 79, 160/81, 59; 135/89; 403/374, DIG. 8, 350, 351; 74/546, 557, 543, 544, 545, 528, 531; 81/73

[56] References Cited

U.S. PATENT DOCUMENTS

| | | | |
|---|---|---|---|
| 1,842,402 | 1/1932 | Heiser | 160/70 |
| 1,856,161 | 5/1932 | Heiser | 160/70 |
| 1,915,529 | 6/1933 | Heiser | 160/70 |
| 2,038,259 | 4/1936 | Anton | 160/70 |
| 2,740,470 | 4/1956 | D'Azzo | 160/70 |
| 3,105,391 | 10/1963 | Thompson | 74/529 X |
| 3,259,407 | 7/1966 | Welt | 403/350 |
| 3,503,566 | 3/1970 | Travis | 135/89 X |
| 4,715,089 | 12/1987 | Schema | 74/546 X |
| 4,733,683 | 3/1988 | Pozzi | 160/68 X |
| 4,997,021 | 3/1991 | Brutsaert | 160/22 |

*Primary Examiner*—Blair M. Johnson
*Attorney, Agent, or Firm*—James Creighton Wray

[57] ABSTRACT

Improvements for an awning in which the slope of the extension arms (5) is regulated by a connecting piece (16) of the binding of each extension arm (5) to the awning casing (4), and in which the operating handle (9) is made up of telescopic elements, and is also provided with a freely moving suspended sleeve (30) for hitching on the ingoing shaft.

6 Claims, 3 Drawing Sheets

ROLL-UP AWNING

BACKGROUND OF THE INVENTION

The present invention relates to improvements for a roll-up awning.

In Belgian Patent Application 08801124 a solution has already been sought both in the field of the connection between the awning casing and the extension arms and in the field of the coupling between the drive mechanism and the operating handle.

The subject of the present invention lies in both fields. In Belgian Patent Application 08801124 the two rear bars of the extension arms are hingedly connected by means of a coupling piece to the awning casing which is provided with an axis of rotation (23) which is situated low down in the awning casing and by means for which during unrolling of the awning said coupling piece can tilt with the extension arms, as a result of which the awning acquires its suitable slope, while with rolling up of the awning the tilting of the extension arms goes in an opposite direction without a part being able to be closer to the rear side of the awning casing. Thanks to this invention it is possible to place the coupling piece close up against said rear side and to take the fully folded extension arms into the fully closed awning casing with a minimum of space.

Yet the problem of the regulation of the slope of the awning canvas has remained.

SUMMARY OF THE INVENTION

The object of the present invention is to give an answer to this shortcoming and to prevent the vertical up and down movement of the connecting pieces of the extension arms with the awning casing.

The awning according to the invention is characterized in that the coupling piece connecting the rear bars to the awning casing is provided with two shafts, one of which is used as a shaft by means of which said coupling piece can tilt lightly hingedly with the extension arms under the pressure exerted on the other shaft by means of an adjustable lock which actually determines the angle of the coupling piece relative to the supporting face of the awning. In the field of the coupling between the drive mechanism and the operating handle, Belgian Patent Application 08801124 describes an operating handle which ends on a bar-shaped part provided with one or more pins which can be slid into corresponding slots of a cylindrical sleeve, as a result of which the cylindrical sleeve which is connected to the shaft of the drive device can be turned forward and back.

Yet there are still a number of difficulties with such operating handles, more particularly with the length of the handle, which is not so easy to pack with the awning, and with the operation itself, which requires the person operating the handle to hold it virtually vertically. For the latter there is, of course, the "Cardan" solution as the connection to the drive shaft, but this solution requires a precision construction and is easily put out of order, which therefore adversely affects its economic benefit.

These problems are solved in he case of the operating handle according to the invention.

The operating handle according to the invention is characterized in that the handle bar is made up of two pieces, a tube and a rod, in which the rod can slide telescopically into the tube, and which can be locked at the suitable length of the operating handle.

The operating handle according to the invention is further characterized in that the operating handle ends at the side of the drive shaft in an eye to which a cylindrical sleeve with adapted slots can be hooked and to which a coil spring is fixed, which spring allows said cylindrical sleeve controlling the drive shaft to turn forward and back from a certain angle.

BRIEF DESCRIPTION OF THE DRAWINGS

All this will be clearer with the aid of the description which follows of an embodiment of the invention, a description which refers to the appended figures, in which.

DETAILED DESCRIPTION OF THE DRAWINGS

Figure 1:
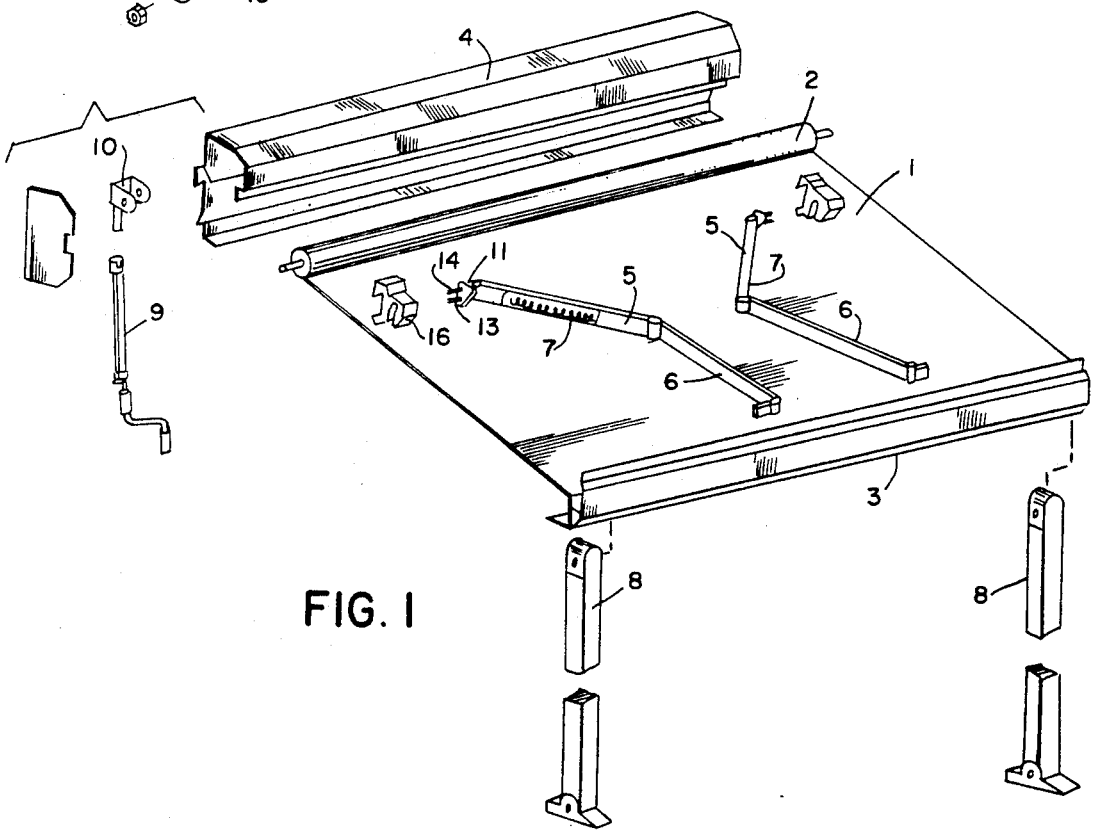
FIG. 1 is a perspective view of an awning according to the invention, divided into its different parts.

An awning of the type shown in FIG. 1 in general comprises an awning canvas (1) which is connected at one side to the awning roller (2) and at the other side to a front section (3). The awning roller (2) is suspended in an awning casing (4) which is open at the front and which is shut off by means of the front section (3) when the awning is fully rolled up. The front section (3) is connected by at least two extension arms (5) to the awning casing (4). The extension arms (5) each comprise two bars (6) and (7) which are hingedly interconnected and which are provided with an internal spring mechanism which forces the extension arms (5) to their extended positions. The front section (3) can, if desired, also be provided with two or more supports (8) for supporting the front section (3). The awning roller (2) is driven manually by an operating handle (9) via a drive mechanism (10).

Figure 2:
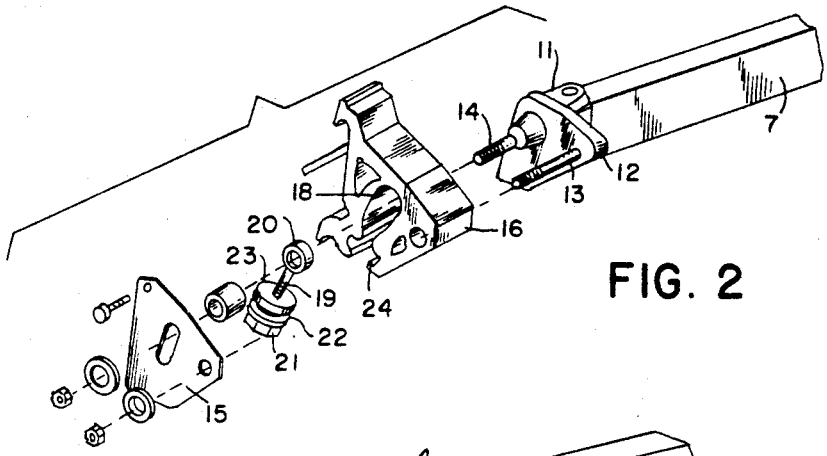
FIG. 2 is a perspective view of the connecting elements between the extension arms and the awning casing of an awning according to the invention.

According to the invention the coupling (FIG. 2) between the extension arms (5) comprises a bracket (11) between which the end of the rear bar (7) is hingedly connected.

The coupling piece also comprises a plate (12) to which the bracket (11) is connected at one side and which at the other side is made up of two shafts (13) and (14) of which the ends are provided with a screw thread in order to screw said coupling piece to the cover plate (15) of the awning casing (4).

A connecting piece (16) is produced by extrusion between the cover plate (15) of the awning casing (4) and the coupling piece plate (12) and is provided with, inter alia, two cavities (17) and (18) through which the respective shafts (13) and (14) of the coupling piece are inserted.

The cavity (17) of the connecting piece (16) through which the front shaft (13) of the coupling piece is inserted is of a diameter which is barely larger than the diameter of the front shaft (13), which allows the coupling piece with the extension arms (5) to tilt about the front shaft (13).

On the other hand, the rear cavity (18) is slightly larger than the front cavity (17) and is provided at the bottom with an open slot through which a lock (19) can be pushed into said rear cavity (18) of the connecting piece, and can largely occupy the space of said rear cavity (18).

The top end of this lock (19) is formed by an eye (20) through which the rear shaft (14) of the coupling piece is inserted, while at the bottom the lock is in the form of a bolt (21) on which a round nut (23) is screwed. This nut (23) is slid into a slot (24) intended for it and forming part of the rear cavity (18) of the connecting piece (16). According to whether the head of the bolt (21) is turned with a key in one or the other direction, since the round nut (23) cannot move in the slot (24) of the connecting piece (16), the bolt (21) with eye (20) rises or falls, with the result that the shaft (14) with the coupling piece and the extension arms (5) also tilts forward or back about the shaft (13).

With an awning according to the invention it is thus possible once the awning casing (4) is fixed to a wall to regulate the angle of the slope of the awning canvas and to lock it through use of a closing ring (22) which is screwed tightly between the head of the bolt (21) and the connecting piece (16). With this lock, the coupling piece to which the extension arms are connected cannot achieve any further up and down movement.

Figure 3:
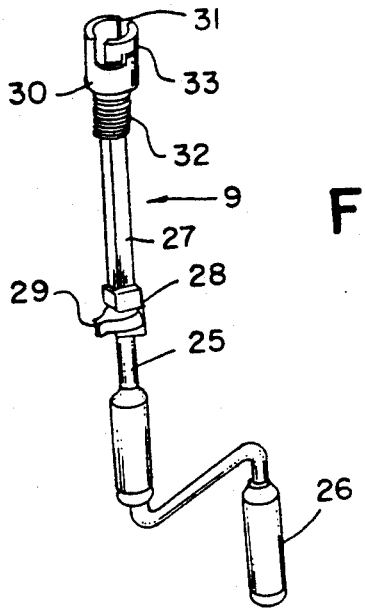
FIG. 3 is a perspective view of an operating handle of an awning according to the invention.

The awning according to the invention is also provided with an operating handle (9) (FIG. 3) of which the handle bar is made up of two parts, at one side at the bottom comprising a bar (25) provided as usual with a handle (26) allowing the bar (25) to rotate about the axis formed by the bar (25), and at the other side at the top comprising a tube (27) which is round or square and corresponds to the cross-section of bar (25) which can be slid telescopically into tube (27).

Figure 4A:
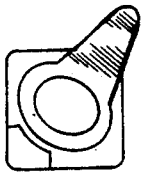
FIG. 4 is a detail of the locking means of the handle.
Figure 4B:
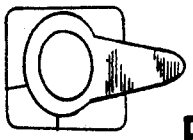
Figure 4:
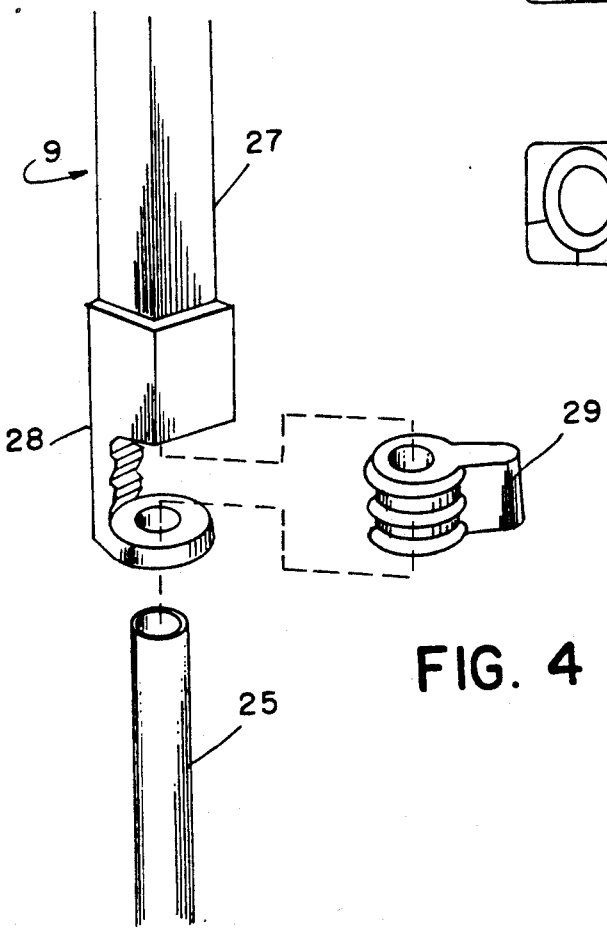

At the desired length of the operating handle (9), according to the height at which the awning casing was placed and the size of the person operating the handle (9), the position of the bar (25) in the tube (27) can be locked by a lock (28) which is fixed to the bottom end of tube (27), and which comprises a cylindrical space through which the bar (25) is slid, but with an axis which is situated off-center relative to the axis of the bar (25), in such a way that with the turning of said lock (28), as seen in FIG. 4, under the pressure of a finger on the projection (29) with which lock (28) is provided the bar (25) is locked in tube (27).

The awning according to the invention is also characterized in that the operating handle (9) at the level of the drive mechanism is made up of three pieces, in the sense that the top part of the handle itself, tube (27) ends in an eye (not visible in FIG. 3) in which a hook (33) is provided, at the bottom forming part of a cylindrical sleeve (30) provided with slots (31).

Figure 5:
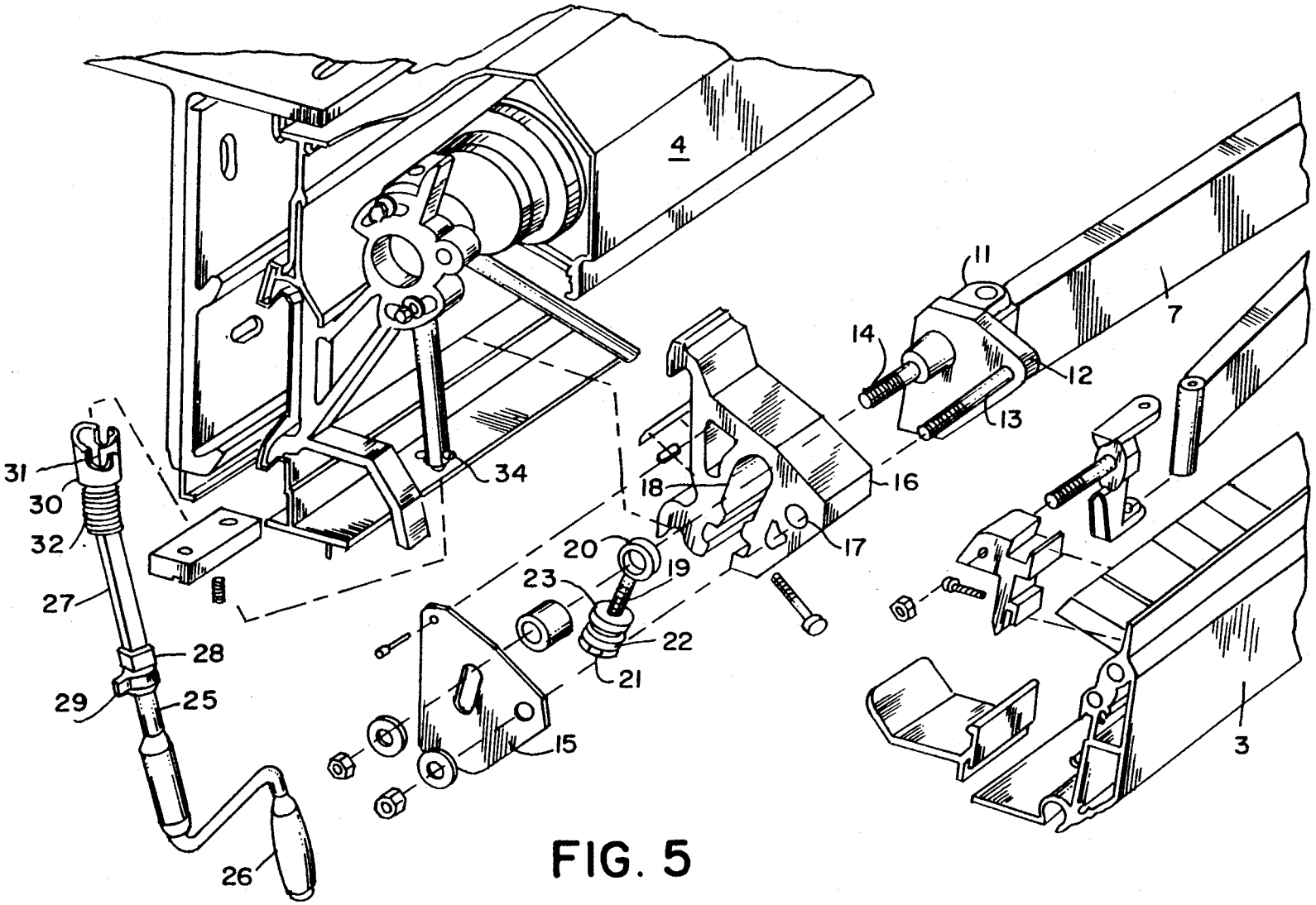
FIG. 5, is an exploded view of the elements of the invention.

These slots (31) are used to connect the cylindrical sleeve (30) to the pins 34 of an ingoing shaft (FIG. 5). This shaft forms part of the drive mechanism (10). Once sleeve (30) is hitched relative to said pins, said sleeve (30) is directed vertically, while the operating handle is suspended from it and can move freely in a conical space about an imaginary vertical axis. This movement is further limited and said sleeve (30) is supported by means of a coil spring (32) connected to tube (27).

I claim:

1. An awning comprising an awning canvas, an awning casing, an awning roller for rolling up or unrolling the awning canvas suspended in the awning casing, a front section to which a front edge of the awning canvas is connected, and at least two extension arms, each arm comprising a front bar with one end being hingedly connected to the front section and a rear bar with one end being hingedly connected to the another end of the front bar, an internal spring mechanism which forces both bars to an extended position, and the rear bar having at another end a connecting means for tiltably moving the bar, the connecting means comprising a coupling piece fixed to a cover plate of the awning casing, wherein said coupling piece comprises a bracket on an inner side of the coupling piece for hingedly connecting the other end of the rear bar, and the coupling piece further comprises on an outer side, integrally formed front and rear shafts, wherein each of said shafts run through a tiltable connecting piece, and each distal end of each of the shafts are fixed to the cover plate of the awning casing, the connecting piece having means for regulating and locking a sloping angle of the coupling piece thereby regulating and locking the sloping of the awning casing and the awning canvas, respectively.

2. The awning as claimed in claim 1, wherein the connecting piece (16) is provided with a front cavity (17) adapted to a diameter of the front shaft (13) of the coupling piece in such a way that the coupling piece with the extension arms (5) can tilt forward and back about the front shaft (13).

3. The awning as claimed in claim 1, wherein the connecting piece (16) is provided with a rear cavity (18) which is large enough and of such a shape that a lock (19) is pushed into it through which runs the rear shaft (14) of the coupling piece to which the extension arm (5) is connected.

4. The awning as claimed in claim 1, wherein the connecting piece (16) is made of extruded material.

5. The awning as claimed in claim 3, wherein the lock (19) is provided at the top with an eye (20) through which the rear shaft (14) of the coupling piece can be inserted, while at the bottom said lock is in the form of a bolt (21) on which a round nut (23) is screwed, which nut is fixed in an appropriate slot (24) of the rear cavity (18) of the connecting piece (16) and ends with a polygonal head in order to make a bolt (21) turn up or down, which movement is transmitted to the rear shaft (14) which therefore can tilt forward or back with the coupling piece about the front shaft (13).

6. The awning as claimed in claim 5, wherein the lock is also provided with a closing ring (22).

* * * * *